United States Patent [19]

Bose et al.

[11] Patent Number: 5,011,298

[45] Date of Patent: Apr. 30, 1991

[54] HALTER TOP BAG

[75] Inventors: Ajit K. Bose, Lawrenceville, N.J.; Kurt F. Strater, Barnesville, Ga.

[73] Assignee: Union Camp Corporation, Wayne, N.J.

[21] Appl. No.: 534,797

[22] Filed: Jun. 7, 1990

Related U.S. Application Data

[63] Continuation-in-part of Ser. No. 299,860, Jan. 19, 1989, abandoned.

[51] Int. Cl.[5] ..... B65D 30/10; B65D 30/20; B65D 33/06

[52] U.S. Cl. ..... 383/8; 383/120; 383/907

[58] Field of Search ..... 383/8, 120, 907

[56] References Cited

U.S. PATENT DOCUMENTS

| | | | |
|---|---|---|---|
| 1,623,107 | 4/1927 | Koontz | 383/120 |
| 2,688,914 | 9/1954 | Eckler | 383/907 |
| 3,172,796 | 3/1965 | Gulker | 383/907 |
| 3,276,670 | 10/1966 | Harvey | 383/120 |
| 3,693,120 | 9/1972 | Knotts | 383/120 |
| 4,943,167 | 7/1990 | Gelbard | 383/8 |

*Primary Examiner*—Stephen P. Garbe
*Attorney, Agent, or Firm*—Edward J. Sites

[57] ABSTRACT

The invention is of a halter top, thermoplastic resin film bag which is an improvement over the T-shirt type of bag, in that the base area where the gussets are sealed is strengthened by the trapezoidal configuration given to the bag of the invention.

1 Claim, 2 Drawing Sheets

HALTER TOP BAG

This application is a continuation in part of application Ser. No. 299,860 filed Jan. 19, 1989 now abandoned.

BACKGROUND OF THE INVENTION

1. Field of the Invention

The invention relates to thin-film thermoplastic bag structures and, more particularly, is concerned with handled bag structures useful to transport goods such as groceries.

2. Brief Description of the Prior Art

The bag art is an old one and more recently has evolved from bags made of paper and cloth to flexible bags made of extruded films of a synthetic polymeric resin. An early U.S. Pat. (No. 1,253,269) issued to W. J. Moeller in 1918 described paper and cloth bags of a triangular, truncated construction. Subsequently, the U.S. Pat. No. 2,688,914 (Eckler) described envelopes for containing slices of citrus fruits, made of heat-sealable thermoplastic resins in the form of a flat trapezoidiform sack.

The use of flexible films of thermoplastic resins to fabricate bags and bag-like containers enabled the art to make containers in a variety of shapes including trapezoidal; see for example U.S. Pat. No. 3,003,681 issued in 1961 to Orsini.

Further improvements included the attachment of handles to the flexible bags; see U.S. Pat. No. 4,040,562 (Ward, et al.), also describing a flat, frusto-conical shaped bag.

In more recent years, the art has fastened its attention on development of tubular film bags having handles and suitable for use in carrying, for example, groceries from grocery markets. The special requirements of the grocery bag are high-tensile strength, impact and penetration resistance, and handle strength, the bag being tear resistant at stress points. Further requirements from the manufacturers' view point are extremely thin, flexible films having a minimum resin weight to promote low cost. Representative of the latter bags are those described in U.S. Pat. Nos. 4,165,832 (Kuklies, et al.) and 4,326,664 (Benoit, et al.). These bags, known in the art as "T-shirt bags" because of their handled shape, are prepared by blow extruding a film of resin in a tubular shape, folding the tube in a certain manner, and cutting continuous lengths of the extruded tube into appropriate sizes. The sides and ends may be heat sealed to close the bag structure. Techniques of extruding the films are also well known in the art; see for example U.S. Pat. Nos. 4,022,558; 4,118,453; 4,472,343; and 4,626,397.

Present commercially available T-shirt bags include straight gussets. These bags have inherent weak points at the middle zone of the bag bottom where the gussets are sealed to the base. The bags of the present invention have varying gusset depths (widths) below the handle area. This particular construction shifts the inherent weak points to the outer periphery of the bags where the loads are not usually as severe as they are at the base center of the bag. The invention is particularly useful in the construction of bags from polyolefin resins. In the prior art, polyolefin bags, particularly those made from high molecular weight-high density polyethylenes, are prone to develop holes when the bags are loaded and lifted. Even with linear low density polyethylene bags, the seal of the gussets at the base, having the same stress points, develops holes during use. This problem is substantially obviated by the particular construction of the bags of the present invention.

SUMMARY OF THE INVENTION

The invention is a halter top bag formed from relatively thin, tubular films of a thermoplastic resin. The front and rear bag panels are trapezoidal in shape and the side gusset panels are substantially wider at the top of the bag body than at the base of the bag.

The trapezoidal configuration in conjunction with the gusset design serves to redistribute the load on the base of the bag in such a manner as to relieve stress points typically found in conventional T-shirt bags. As a result, less tearing occurs along the bottom of the bag due to the increased strength imparted to the bag by the design of the halter top bag.

DETAILED DESCRIPTION OF THE PREFERRED EMBODIMENTS OF THE INVENTION

A complete understanding of the invention may be had by a reading of the following description of the preferred embodiments, taken with a viewing of the accompanying drawings of FIGS. 1–4.

Figure 1:
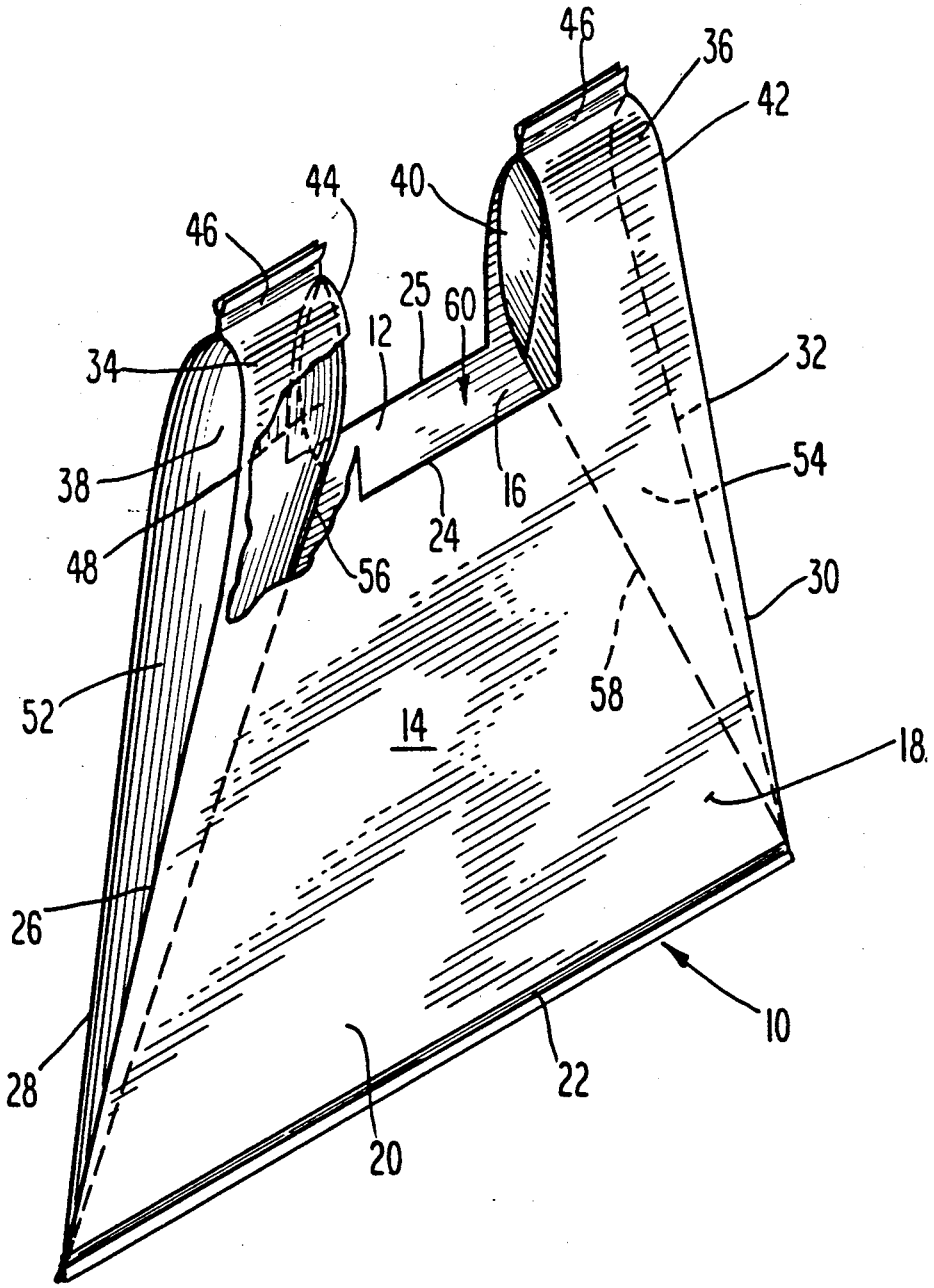
FIG. 1 is a view in perspective of an embodiment of the bag invention, partially cut away, shown with the bag mouth in an open position.

Referring first to FIG. 1, there is seen a view in perspective, partially cut-away, of an embodiment of the invention, shown in a partially open position to receive articles such as groceries.

The bag 10 may be fabricated from extruded tubes of substantially uniform diameter and relatively thin films of thermoplastic resins. The resins used are preferably thermoplastic polyolefins such as polyethylene, polypropylene, and blends of these resins with other thermoplastic resins, all of which are known and conventionally used in the bag-making art. The bag 10 is formed from a hollow tube of the flexible film by folding upon itself to form a rear panel 12, and a front panel 14. The bag 10 possesses an inner surface 16 and an outer surface 18. An imperforate film body 20 is defined by and between the inner and outer bag surfaces 16, 18. As can be seen in FIG. 1, panel 14 is of a substantially trapezoidal configuration including a base end 22 and a parallel peak end 24. A first side edge 26 and a non-parallel second side edge 30 together with the base end 22 and peak end 24 define the peripheral edge of the front panel 14. Rear panel 12 is substantially identical to front panel 14 in size and configuration and has corresponding ends 22, 25 and side edges 28, 32. A pair of handle members 34, 36 above the front panel 14 and a pair of handle members 38, 40 above the rear panel 12 are integrally joined to and extend outwardly from the peak ends 24, 25 of the front and rear panels 14, 12. These handle members 34, 36, 38, 40 are compression heat sealed together at the top thereof to form a pair of handles between the panels 12, 14 and above the bag mouth 60 which is defined by the handles and peak ends 25, 24 of the rear and front panels 12, 14 taken together. The base ends of panels 12, 14 are compression heat sealed together at the bottom of bag 10 to form a bottom seam 22.

The folding of the tubular film is such to also form two integral gussets 52, 54, one at each of the first and second side edges 26, 28 and 30,32 of the panels 14, 12. A first gusset panel 52 is between and integrally joins together the front and rear panels 14, 12. The gusset panel 52 has a greater width at the gusset top 50, a point adjacent to the peak end 24 of the bag 10, than at a point adjacent to the base end 22 of the bag 10; see FIG. 4, a side view of gusset panel 52 opened up.

A second gusset panel 54 is positioned between and integrally joins together the second side edges 30, 32 of the front and rear panels 14, 12. The second gusset panel 54 conforms in size and configuration to panel 52. The gusset panels 52, 54 are folded inwardly in FIG. 1 along the fold lines 56 and 58, respectively.

Figure 2:
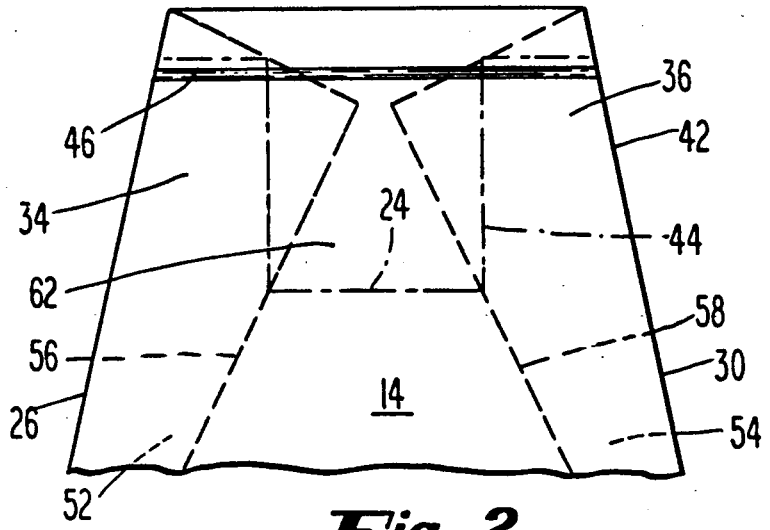
FIG. 2 is a front view of the invention illustrating how the handle members, peak ends, and gusset top are formed.
Figure 3:
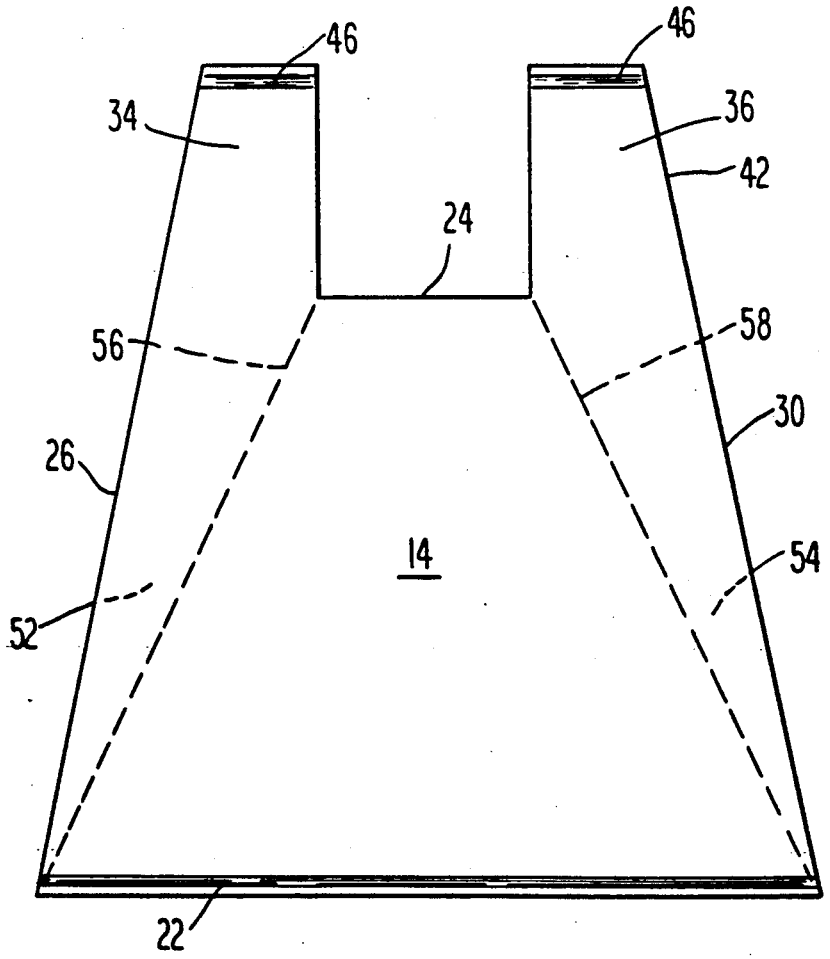
FIG. 3 is a front view of the invention illustrating the peripheral configuration of the bag.

The handle members 34, 36, 38, 40, the peak ends 24, 25, the top handle edge 46, and the gussets 52, 54 are all formed simultaneously by a die cut; see FIG. 2 and 3. The gusset panels 52, 54 are folded inwardly along the fold lines 56 and 58, respectively; thus forming the trapezoidal configuration of the front and rear panels 14, 12.

A die is then utilized to remove the die cut-out area 62. The removal of the cut-out area 62 forms the handle members 34, 36, 38, 40; each member having an inner handle member edge 44 and an outer handle member edge 42. At the same time, the peak ends 24, 25 and the top handle edge 46 are formed by the die-cut.

Subsequent to the die-cut, the top edges of the respective front and rear handle members 34, 38 are compression heat sealed to form the sealed top handle edge 46. The base ends 22 of the front and rear panels 14, 12 are also compression heat sealed to form the base end of the bag 22. See FIG. 3.

Figure 4:
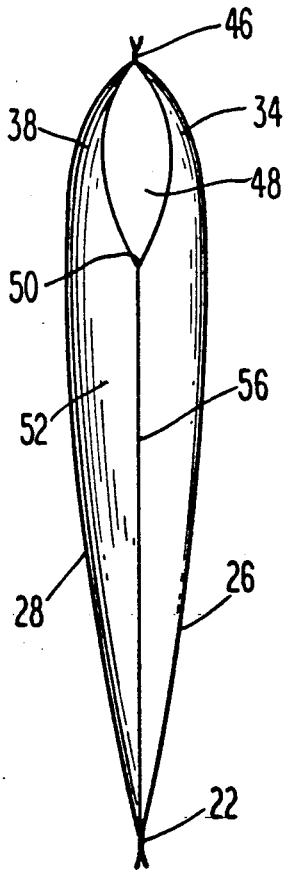
FIG. 4 is a side view of the opened gusset and handle area.

FIG. 4 shows a side view of the opened gusset and the handle area. The trimming of the excess gusset panel 52, seen protruding into the die cut-out area in FIG. 2, also forms the gusset top 50. The handle loop 48 is bounded by the gusset top 50, the front and rear handle members 34, 38, and the sealed top handle edge 46.

It is noted that the handle members 34, 38 and the gusset top 50 are formed from the same body of tubular film (i.e. the bag). Consequently, the handle members are an integral part of the bag and do not require any means of attachment to the bag.

The embodiment of bag 10 may be made in the same manner and by the same general procedures employed to make the known T-shirt bags with straight gusset panels. Folding apparatus employed to make straight gusset bags may be modified by using a gusset inserting disc attached to a cam. The disc can be programmed to insert a four inch tuck over a distance approximately equal to the handle length and then to travel outwardly progressively to decrease the tuck to about zero to 0.5 inches at the base end of the bag.

The following example describes the manner and process of making and using the invention and sets forth the best mode contemplated by the inventor for carrying out the invention.

EXAMPLE

A blown, tubular film of a high molecular weight, high density polyethylene is provided, having a thickness of about 0.55 to 0.65 mils. The tube is folded and cut to form a T-shirt bag, using an 8 inch gusset board disc to insert a 4 inch tuck over a 6 inch length of the tube, representing the handle area. The disc then travels outwardly to decrease the tuck to about 0 to 0.5 inches at the base of the bag, and the bottom is sealed to provide a bag having the configuration shown in FIG. 1.

For comparative purposes a conventional T-shirt bag is formed with a straight 4 inch gusset, of the same film.

The two bags are subjected to the T-shirt bag jog test. The straight gusseted bag when tested, i.e., when loaded with two 1-gallon square shaped milk jugs and jogged, i.e., simulated customer carrying the bag, always creates round shaped holes at the gusset joints. The test, which amounts to a 25 lb. weight jogged with a 6 inch stroke (50 cycles/min. jog), does not create holes in the trapezoidal bag of the invention.

Those skilled in the art will appreciate that many modifications of the above-described preferred embodiments can be made without departing from the spirit and the scope of the invention. For example, the upper ends of the gusset panels 52, 54 can be opened to permit insertion of fingers through the bag handles.

What is claimed:

1. A halter top bag, which comprises;

a hollow tube of substantially uniform diameter formed from a flexible film of a thermoplastic resin, folded upon itself to form (a) a rear panel having (i) an inner bag surface;

(ii) an outer bag surface;

(iii) an imperforated film body defined by the inner and outer bag surfaces and having a substantially trapezoidal configuration including a base end, a peak end, a first side edge and a second side edge; and (iv) a pair of handle members integrally joined to and extending outwardly from the peak end of the film body, said handle members having an inner side edge intersecting the peak end and an outer side edge integrally joined to the respective panel side edge.

(b) a front panel having (i) an inner bag surface;

(ii) an outer bag surface;

(iii) an imperforate film body defined by the inner and outer bag surface (b) (i) and (ii) and having a substantially trapezoidal configuration including a base end, a peak end, a first side edge and a second side edge; and (iv) a pair of handle members integrally joined to and extending outwardly from the peak end of the front panel film body, said handle members having an inner side edge intersecting the peak end and an outer side edge integrally joined to the respective panel side edge.

(c) a first gusset between and integrally joining together the first side edges of the film bodies of the front and rear panels, said gusset having a width at a point adjacent to the peak edges of the film bodies, which is twice the distance from a point of intersection of the peak end and the inner handle member edge and a point horizontally disposed from said point of intersection on the outer handle member edge; said gusset width decreasing linearly to a width of about zero to 0.5 inches at a point of intersection of the first side edges of the front and rear panels and the base end;

(d) a second gusset between and integrally joining together the second side edges of the film bodies of the front panel and rear panels, said second gusset having a width at a point adjacent to the peak edges of the film bodies which is twice the distance from a point of intersection of the peak end and the inner handle member edge and a point horizontally disposed from said point of intersection on the outer handle member edge; said gusset width decreasing linearly to a width of about zero to 0.5 inches at a point of intersection of the first side edges of the front and rear panels and the base end; and (e) a bag mouth defined by the peak ends of the front and the rear panels taken together;

said front panel overlying the rear panel and conforming in size and configuration to the size and configuration of the rear panel;

said first gusset having a size and configuration conforming to the size and configuration of the second gusset;

the paired handle members of the rear panel being sealed to the paired handle members of the front panel to form a sealed top handle edge, which sealed edge forms a pair of handles at the bag mouth;

the base end of the front panel being sealed to the base end of the rear panel forming a base end of the halter top bag, the width of the sealed base ends being narrower than the bag mouth.

* * * * *